US010138688B2

(12) United States Patent
Umphries et al.

(10) Patent No.: US 10,138,688 B2
(45) Date of Patent: Nov. 27, 2018

(54) WIRELESS DOWNHOLE TOOL POSITIONING CONTROL

(71) Applicants: Don Umphries, New Iberia, LA (US); Gabe Williger, Dallas, TX (US)

(72) Inventors: Don Umphries, New Iberia, LA (US); Gabe Williger, Dallas, TX (US)

( * ) Notice: Subject to any disclaimer, the term of this patent is extended or adjusted under 35 U.S.C. 154(b) by 592 days.

(21) Appl. No.: 14/545,298

(22) Filed: Apr. 20, 2015

(65) Prior Publication Data

US 2015/0226019 A1 Aug. 13, 2015

Related U.S. Application Data

(62) Division of application No. 13/507,377, filed on Jun. 23, 2012, now Pat. No. 9,033,032.

(51) Int. Cl.
*E21B 17/10* (2006.01)
*E21B 23/08* (2006.01)

(52) U.S. Cl.
CPC ..... *E21B 17/1028* (2013.01); *E21B 23/08* (2013.01)

(58) Field of Classification Search
CPC ..... E21B 17/1028; E21B 23/08
See application file for complete search history.

(56) References Cited

U.S. PATENT DOCUMENTS

| | | | | |
|---|---|---|---|---|
| 1,412,213 | A | 4/1922 | Mowers | |
| 1,527,956 | A | 2/1925 | Mowers | |
| 2,344,120 | A | 3/1944 | Baker | |
| 2,888,079 | A | 5/1959 | Cypher | |
| 2,929,455 | A | 3/1960 | Godbey | |
| 3,070,167 | A * | 12/1962 | Lindsey | E21B 23/08 166/153 |
| 3,163,038 | A | 12/1964 | Bryant | |
| 3,891,034 | A | 6/1975 | Owen et al. | |
| 6,564,686 | B1 | 6/2003 | Keeling et al. | |
| 6,722,251 | B2 | 4/2004 | Keeling et al. | |
| 7,258,054 | B1 | 8/2007 | Keeling et al. | |
| 7,527,095 | B2 * | 5/2009 | Bloess | E21B 33/134 166/228 |
| 8,066,066 | B2 | 11/2011 | Linaker | |
| 2001/0006107 | A1 * | 7/2001 | Fritchley | E21B 23/10 166/106 |
| 2011/0127046 | A1 | 6/2011 | Aguirre et al. | |
| 2011/0290474 | A1 | 12/2011 | Nutley | |

* cited by examiner

*Primary Examiner* — Robert E Fuller

(57) ABSTRACT

For a free falling well tool sub having one or more pipe bore centering cages, a collapsible material cone secured inside of the centering cage half length with the cone base opening in the downhole direction restricts the rate of pipe bore fluid flow past the cone and thereby restricts the descent rate of the tool. The rate of descent may be regulated with fluid flow by-pass apertures in the sub. A collapsible material cone in a bore centering cage having a base opening in the up-hole direction may be used as piston to drive the tool sub along horizontal segments of a deviated well bore. Both cones may be used separately or together.

18 Claims, 4 Drawing Sheets

WIRELESS DOWNHOLE TOOL POSITIONING CONTROL

CROSS-REFERENCE TO RELATED APPLICATION

This Application is a Division of and claims priority to presently pending U.S. patent application Ser. No. 13/507,377 titled WIRELESS DOWNHOLE TOOL POSITION CONTROL.

BACKGROUND OF THE INVENTION

Field of the Invention

The present invention relates to deep well operations controlled or initiated by free falling tool subs.

SUMMARY OF THE INVENTION

A cone of flexible material is secured within one or both of the centering spring cages of a free falling well tool connected to or part of a perforating gun, tubing cutter or well logging sensor or similar well tool. In a first operational mode, the invention is preferably utilized to regulate the descent rate of the free falling tool in substantially vertical segments of a well length. In a second operational mode, the invention is a process and tool for driving a well tool along deviated and horizontal segments of a well length where gravity forces are insufficient to sustain displacement. In the second mode, the cone opens against up-hole fluid pressure to drive the tool along deviated, substantially horizontal length segments of a well. The second mode cone also collapses to permit the free by-pass flow of standing well fluid when free falling in vertical length segments of the well.

BRIEF DESCRIPTION OF THE DRAWINGS

The invention is hereafter described in detail and with reference to the drawings wherein like reference characters designate like or similar elements throughout the several figures and views that collectively comprise the drawings. Respective to each drawing figure.

DESCRIPTION OF THE PREFERRED EMBODIMENTS

As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate. Moreover, in the specification and appended claims, the terms "pipe", "tube", "tubular", "casing", "liner" and/or "other tubular goods" are to be interpreted and defined generically to mean any and all of such elements without limitation of industry usage.

Figures 1A, 1B, 1C, 1D, 1E, 1F:
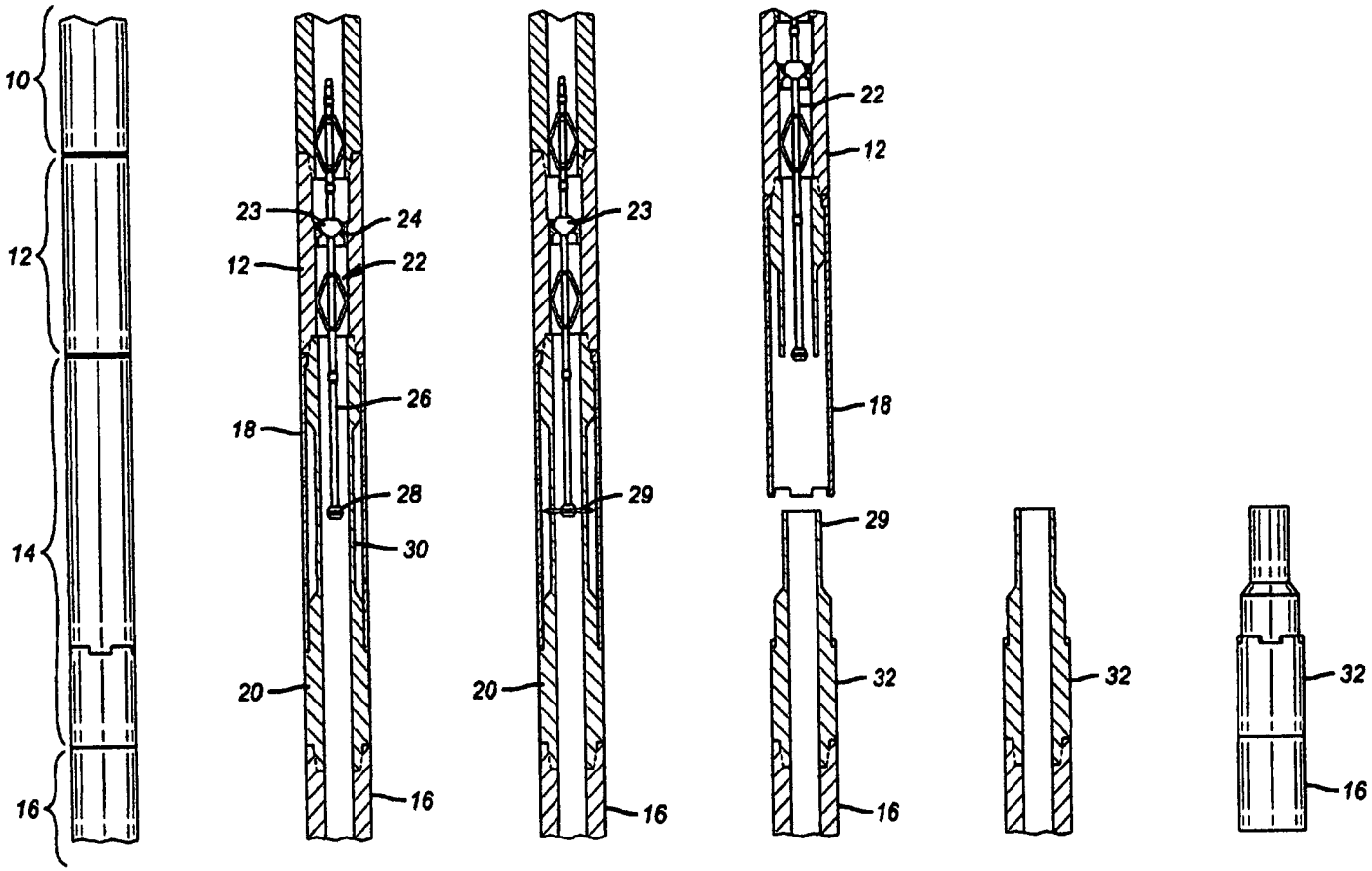
FIG. 1A illustrates a section of pipe string having two sub units inserted between an upper pipe section and a lower pipe section.
FIG. 1B is a sectioned view of FIG. 1A showing a drop assembly within the pipe string in pipe cutting position.
FIG. 1C is a sectioned view of FIG. 1A showing the discharge of a jet cutting tool against a reduced wall annulus section of the sacrificial mandrel.
FIG. 1D is a sectioned view of the severed pipe section of FIG. 1C showing withdrawal of the upper pipe section from the severed lower pipe section.
FIG. 1E is a sectioned view of the severed pipe stub remaining below the cut of FIG. 1C.
FIG. 1F is a full profile view of the severed stub remainder of the pipe section.

A basic utility of the present invention, as practiced, for example, upon a drill string cutting operation, is represented by the six views, A through F of FIG. 1. The FIG. 1A view shows an assembly of the basic downhole pipe string components between an upper section 10 and a lower section 16. An expanded description of each of these constituent components will follow hereafter.

The FIG. 1A illustration is usually most relevant to that heavyweight section of drill pipe 16 at the bottom end of a drill string having joints of pipe with extremely thick wall annuli. To the well driller's art, these pipe joints with exceptionally thick walls are known as "drill collars". A seating sub 12 and cutaway sub 14 may be positioned at the upper end of the collar section or at any intermediate point or at numerous points below the upper end. However, those of ordinary skill will understand that the principles described herein with respect to drill collars are applicable to any form or application of pipe or tube.

Referring to the sectioned view of FIG. 1B, an independent drop assembly 22 is released at the surface to be driven by pump pressure or to descend in free-fall along the pipe bore to terminate with a seating plug element 23 of the drop assembly 22 coming to rest upon a plug seating aperture 24 in the seating sub 12. A drop assembly extension 26, usually extending below the seating aperture 24 is shown to support a jet cutting pyrotechnic tool such as a thermite or shaped charge explosive 28. The extension 26 length is selected to place the jet cutter 28 within the pipe bore opposite a thin wall section 30 of a sacrificial mandrel 20 portion of the cutaway sub 14.

FIG. 1B illustrates the drop assembly 22 seating plug 23 as firmly resting upon seating aperture 24. As more expansively described by the specification of our U.S. Pat. No. 8,272,441, fluid pressure within the upper pipe string bore is increased to open a firing head valve disposed within the drop assembly 22. Opening the firing head valve initiates the jet cutter 28 ignition sequence to discharge a high temperature cutting jet along cutting plane 29 against the thin wall section 30 of the sacrificial mandrel 20 as represented by FIG. 1C.

With the thin wall section 30 of the sacrificial mandrel 20 severed, FIG. 1D shows the seating sub 12 and torque sleeve 18 portions of the upper pipe string 10 as free to separate from the sacrificial mandrel stub 32 which remains fixed to the well bottom. FIG. 1E shows the sacrificial mandrel stub 32 portion of the cutaway sub 14 in section as remaining with the well bottom pending further, independent action of recovery or well abandonment. FIG. 1F shows the mandrel stub 32 in full profile.

Figure 2A:
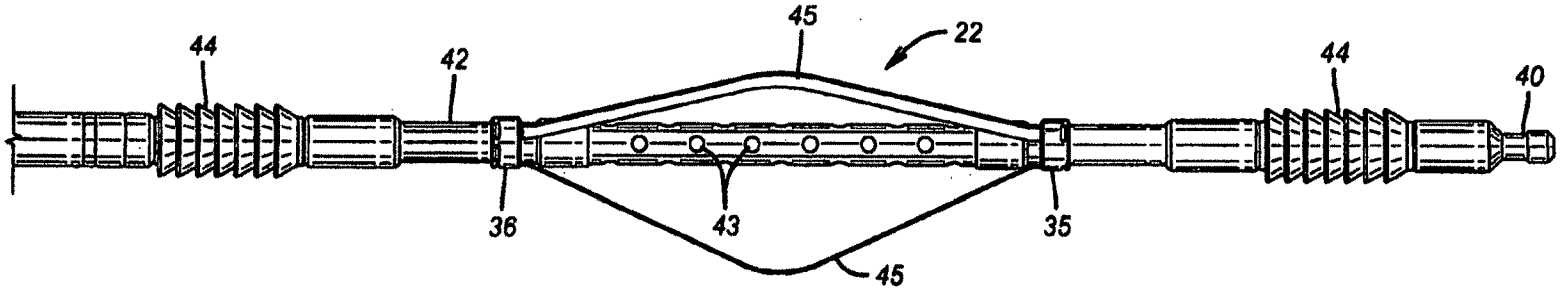
FIG. 2A is an elevation view of the upper portion of a first invention embodiment.
Figure 2B:
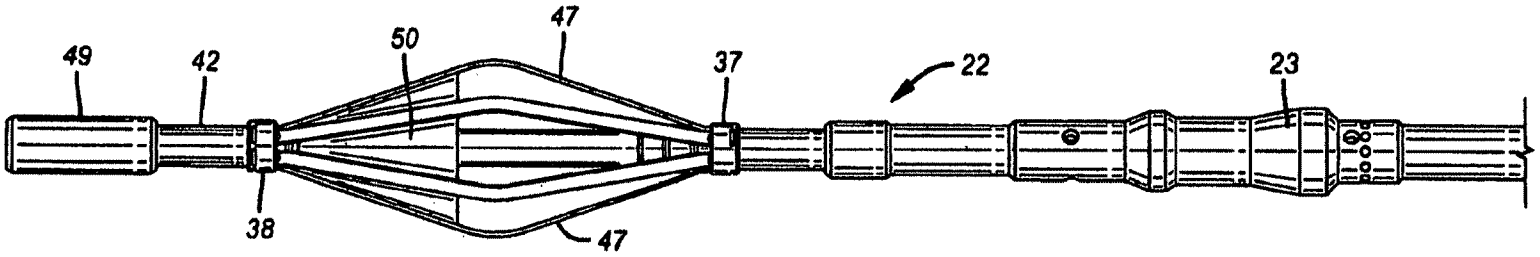
FIG. 2B is an elevation view of the lower portion of the first invention embodiment.

In detail, the drop sub embodiment 22 illustrated by FIGS. 2A and 2B comprises a stem tube 42 that is terminated at its upper distal end by a wireline connecting pin 40 for wireline retrieval. Apertures 43 through the stem tube wall open the internal flow bore of the stem tube to the surrounding environment. Wiper sets 44 may be positioned above and below the apertures. Arching over the apertures 44 as surface elements of a bowl are a plurality of bore centering spring leaves 45. The spring leaves 45 arch between collars 35 and 36 in the manner of a resilient cage surrounding the stem tube 42. The collars surround the stem tube 42 and secure the spring leaves radially to the stem tube. However, at least one of the collars 35 and 36 is substantially free to axial displacement along the surface of the stem tube. The opposite distal ends of each spring leaf are secured to a respective one of the collars 35 and 36.

Referring to FIG. 2B, a seating plug 23 is shown to be positioned below the apertures 44 and spring leaves 45. Below the seating plug 23, is a lower set of centering spring leaves 47. As in the case of the upper spring cage, the distal ends of spring leaves 47 are secured to axially sliding collars 37 and 38. A coupling 49 terminates the lower distal end of the stem tube 42. Well treatment and operational tools such as a jet cutter 29 assembly may be secured to the coupling 49. An axial bore through coupling 49 is in fluid communication with the stem tube apertures 43 for actuation of the attached operational tool.

Figure 6:
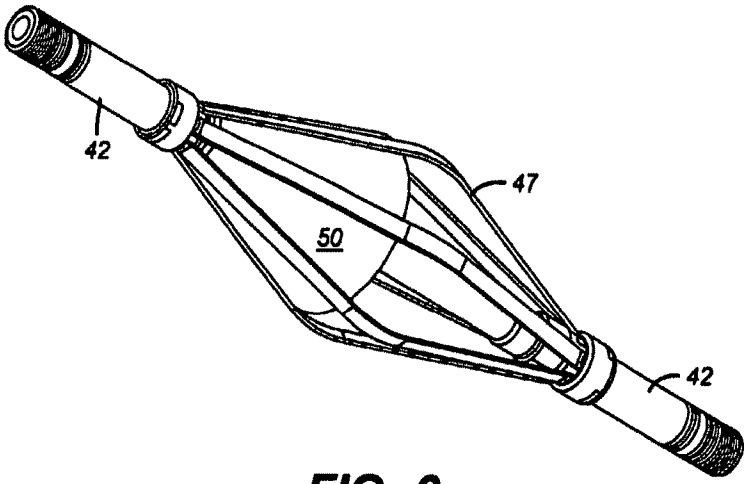
FIG. 6 is a pictorial view of the invention.
Figure 5:
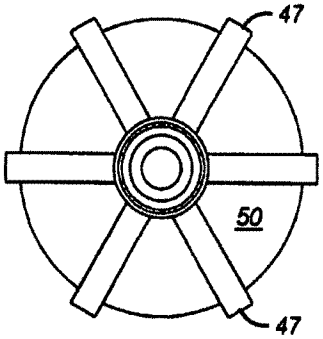
FIG. 5 is an end view of the flexible cone section of the invention.

As illustrated by FIGS. 5 and 6, within the cage of centering springs 47 is a cone 50 of flexible, fluid barrier material. Axial length of the cone 50 extends from a relatively tight attachment of the small, apex end to the outer perimeter of the stem tube 42 to approximately the arc bight of the leaves 47. The large diameter end of said cone is as great or greater than the inside bore of the well pipe string. This large diameter end of the cone 50 is oriented up-hole and may be substantially free of structural attachment to the leaves 47 of the spring cage to collapse and facilitate fluid flow past the cone 50 when in bore free fall. However, when the movement of pipe bore fluid is directed against the upper, larger end of the cone 50, the cone opens to function as a piston for driving the sub 22 along the pipe bore.

Fluid supplies into most deep well service operations are provided by positive displacement pumps that discharge a known volume of fluid for each revolution or cycle of the pump. This known discharge volume into the closed volume of a downhole pipe 10 bore may be translated to a known axial displacement distance of the drop sub assembly 22 along the pipe 10 length for each pump cycle when the cone 50 within the lower centering spring 47 opens to substantially prevent bypass flow around the cone. Consequently, a well operator may determine the exact position of a drop sub assembly 22 with reasonable precision by simply counting the number of pump revolutions.

As used herein, the term "fluid barrier" to describe the cone 50 fabrication material is to be interpreted in a sense that the well fluid of a specific application does not pass freely through it. Hence, the term must be interpreted in the context of the physical characteristics of the fluid in which it is to be immersed. This would include a range of materials from membranes that are substantially impermeable to water or gas to strong, loosely woven fabrics immersed in a viscous, high gravity drilling mud.

Other preferable material characteristics of cone 50 are such as to readily collapse away from the centering springs 47 when the drop sub assembly 22 is free falling by gravity to permit fluid standing within the pipe 10 bore to bypass the drop sub. Depending upon the well fluid conditions such as pressure, depth, acidity, viscosity density, rheology and other factors, the material may be a polymer impregnated fabric, reinforced rubber, or woven fiberglass as examples.

Although the FIG. 2B embodiment shows the seating plug 23 to be positioned above the cone 50 and centering spring 47, it will be understood that this is not an essential feature of the invention. In certain field circumstances, it will be preferable to position the plug 23 below or downhole from the cone 50 and centering spring 47.

Figure 3A:
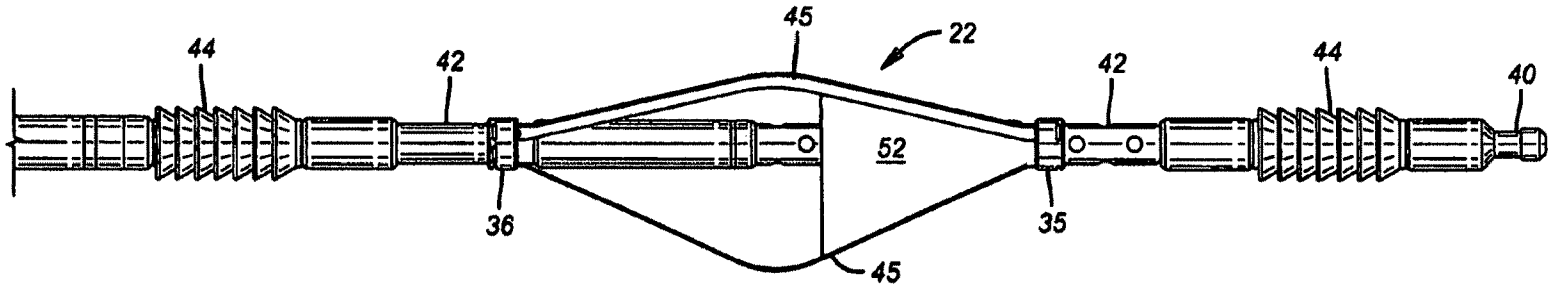
FIG. 3A is an elevation view of the upper portion of a second invention embodiment.
Figure 3B:
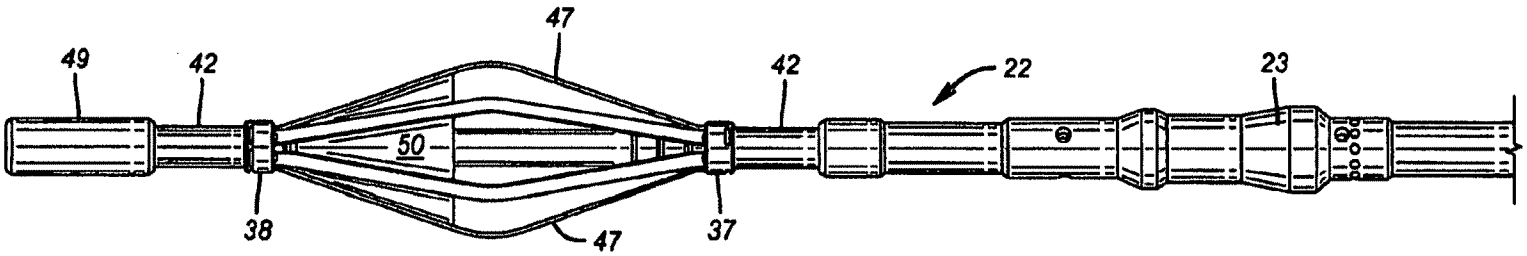
FIG. 3B is an elevation view of the lower portion of a second invention embodiment.
Figure 4:
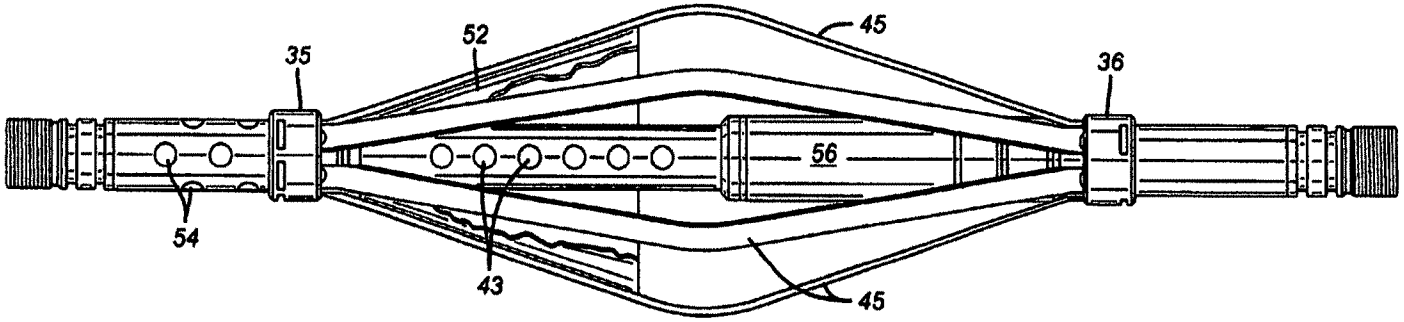
FIG. 4 is a partially sectioned view of the flexible material cone section of the invention

The invention embodiment of FIGS. 3A, 3B and 4 offers another operational utility for the invention by providing a cone 52 within the internal cage of upper centralizer springs 45 independent of or in addition to the lower cone 50 in the cage of spring leaves 47. Cone 52 is oriented with the larger diameter end of the cone below the smaller end. Construction of the cone 52 may be similar to that of the lower cone 50 albeit, not necessarily the same. Operational stress on the cone 50 may be substantially different from that on the lower cone 52.

The cone 52 functions as a brake to retard and slow the gravity driven freefall descent of the drop sub assembly 22. The viscosity and specific gravity of fluid in a pipe pore is highly variable depending on particular well circumstances. In many cases, the fluid may be air or some inert gas, especially in the upper zone of a well, which offers little resistance to the sub assembly descent. Gaseous fluids allow the sub assembly 22 to acquire excessive speed along the pipe string bore thereby jeopardizing the integrity of the attached tool 28 and/or its operation. For example, a severe shock upon landing against the plug seating aperture 24 may prematurely release the fluid pressure actuated firing pin mechanism within pipe stem 42. The cone 52 opens like a parachute to retard the drop sub descent rate.

In the case of the present invention, fluid bypass apertures 54 into the bore of stem tube 42 above the cone 52 cooperate with the valve actuating apertures 43 to provide a restricted fluid flow path past the cone 52 as a descent rate control device. Further control is enabled by a sleeve valve 56 which may be selectively positioned along stem tube to close one or more of the apertures 43.

This combined assembly of FIGS. 3A and 3B permits a regulated freefall descent rate for the drop sub 22 along relatively vertical segments of a pipe 10 bore. Upon entering a more horizontal segment of the well where the gravity forces along the pipe axis are insufficient to drive movement, fluid pressure applied from the surface may collapse the upper cone 52 and expand the lower cone 50 into a ring seal about the internal bore wall of the pipe 10. Additional fluid introduced at the surface to the bore of pipe 10 now displaces the drop sub along the length of pipe 10 without regard to gravity.

As described with respect to the FIG. 2B embodiment, placement of the seating plug 23 between the cones 50 and 52 as shown by FIG. 3B is not an essential configuration. The plug 23 may also be positioned below the lower cone 50.

It will also be obvious to those of ordinary skill that the materials used for the construction of cones 50 and 52 need not be the same nor even similar. There may be considerable differences in operational stress imposed on the respective cones.

While the foregoing description has focused on the preferred embodiments of the invention as for controlling the placement of free-falling or unattached well tools, it will also be appreciated that the invention principles may be applied to pipe and coiled tubing attached tools. In particular, the piston configuration of the invention embodied in cone 50 may be effectively engaged to draw a long string of coiled tubing along a horizontal segment of deviated well.

Although the invention disclosed herein has been described in terms of specified and presently preferred embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention.

The invention claimed is:

1. A method of restraining the descent rate of a well tool within a well pipe comprising the steps of:

securing said tool to an end of a stem tube having a hollow bore;

providing an arched cage around a perimeter of said stem tube;

securing first and second ends of said arched cage to said stem tube;

confining said stem tube to the approximate center of a well pipe by an arched cage surrounding a perimeter of said stem tube; and providing a flexible material cone within said cage having an apex portion secured to said stem tube in an up-hole direction from an open base of said cone, wherein a stem tube wall around said hollow bore is penetrated by apertures on opposite axial sides of said cone apex.

2. The method of restraining the descent rate of a well tool within a well pipe as described by claim 1 wherein a perimeter of said cone base approximates an arc bight of said cage.

3. The method of restraining the descent rate of a well tool within a well pipe as described by claim 1 wherein select portions of said apertures are covered to control a fluid flow rate through said hollow bore past said apex portion of said cone.

4. The method of restraining the descent rate of a well tool within a well pipe as described by claim 1 wherein an axially displaced sleeve is provided around said stem tube to cover selected portions of said apertures.

5. The method of restraining the descent rate of a well tool within a well pipe as described by claim 1 wherein said cage has uphole and downhole ends secured to said stem tube.

6. The method of restraining the descent rate of a well tool within a well pipe as described by claim 5 wherein one of said cage ends is substantially free for axial displacement along said stem tube.

7. A method of controlling the descent rate of a well tool within a well pipe comprising the steps of:

providing a stem tube having an uphole end, a downhole end and an internal follow bore within a tube wall;

securing an arched centering cage around said stem tube, said cage having an uphole end and a downhole end secured to said stem tube wall;

providing within said cage, a flexible material cone having an apex end and an open base end;

securing said apex end of said cone to said stem tube wall proximate of said cage uphole end; and securing a well tool to said downhole end of said stem tube, wherein said stem tube wall is perforated by an aperture above and below said cone apex.

8. The method of controlling the descent rate of a well tool within a well pipe as described by claim 7 wherein an axially displaced sleeve is provided around said stem tube wall to cover selected portions of aperture area.

9. The method of controlling the descent rate of a well tool within a well pipe as described by claim 7 wherein said stem tube wall is perforated by a plurality of apertures above and below said cone apex.

10. The method of controlling the descent rate of a well tool within a well pipe as described by claim 9 wherein an axially displaced sleeve is provided around said stem tube wall to cover a selected number of said apertures.

11. A method of positioning a well tool in a well pipe comprising the steps of:

providing a stem tube having an axial flow bore; securing a well tool to a downhole end of said stem tube;

securing opposite ends of a first centering cage around said stem tube;

securing opposite ends of a second arched centering cage around said stem tube downhole from said first centering cage;

providing a first flexible material cone around said stem tube within said first centering cage;

securing an apex end of said first flexible cone to said stem tube proximate an uphole end of said first centering cage;

providing a second flexible material cone around said stem tube within said second centering cage;

securing an apex end of said second flexible cone to said stem tube proximate a downhole end of said second centering cage;

providing first apertures through a wall of said stem tube into said flow bore between an uphole end of said first centering cage and a downhole end of said second centering cage;

providing second apertures through said stem tube wall into said flow bore uphole from said uphole end of said first centering cage; and controlling a free fall descent rate of said tool along a well pipe by regulating a fluid flow rate through said flow bore from said first to said second apertures.

12. The method of positioning a well tool in a well pipe as described by claim 11 wherein said fluid flow rate through said flow bore is regulated by a sleeve around said stem tube wall that is axially displaced along said wall for covering a selected portion of aperture area.

13. The method of positioning a well tool in a well pipe as described by claim 11 wherein said well tool is driven along said well pipe by uphole pump pressure against said second flexible cone.

14. The method of positioning a well tool in a well pipe as described by claim 11 wherein the uphole end of said first centering cage and the downhole end of said second centering cage is axially secured to said stem tube wall.

15. The method of positioning a well tool in a well pipe as described by claim 14 wherein the downhole end of said first centering cage and the uphole end of said second centering cage is free for axial displacement along said stem tube wall.

16. A method of placing a well tool along the bore of a well pipe comprising the steps of:

securing a well tool to an end of a stem tube having a hollow bore, confining said stem tube to the approximate center of a well pipe by an arched cage surrounding the perimeter of said stem tube;

securing uphole and downhole ends of said arched cage to said stem tube;

providing a flexible material cone within said cage having an apex portion secured to said stem tube in a downhole direction from an open base of said cone;

providing an aperture through a wall of said stem tube and into said hollow bore on an axial side of said apex portion, the wherein the aperture is a fluid flow path; and pumping fluid into said well pipe against said cone for displacement of said stem tube and tool along said well pipe.

17. The method of placing a well tool along the bore of a well pipe as described by claim 16 wherein the downhole end of said arched cage is axially secured to said stem tube.

18. The method of placing a well tool along the bore of a well pipe as described by claim 17 wherein the uphole end of said arched cage is free for axial displacement along said stem tube.

* * * * *